United States Patent [19]

Denman

[11] 4,271,735

[45] Jun. 9, 1981

[54] TOOL HOLDERS

[75] Inventor: Dennis Denman, Retford, England

[73] Assignee: Matthias Spencer & Sons Limited, Sheffield, England

[21] Appl. No.: 77,596

[22] Filed: Sep. 21, 1979

[30] Foreign Application Priority Data

Sep. 21, 1978 [GB] United Kingdom ..... 37581/78

[51] Int. Cl.[3] ..... B23B 29/00; B26D 1/00; B23B 31/10

[52] U.S. Cl. ..... 82/36 R; 407/109; 408/239 R

[58] Field of Search ..... 82/36 R; 408/239; 407/109

[56] References Cited

U.S. PATENT DOCUMENTS

| | | | |
|---|---|---|---|
| 1,538,670 | 5/1925 | Stanley | 408/239 R |
| 2,893,274 | 7/1959 | Mueller | 408/239 R |
| 3,057,609 | 10/1962 | Krekeler | 82/36 R X |
| 4,146,240 | 3/1979 | Neilsen | 408/239 R |

*Primary Examiner*—Harrison L. Hinson
*Attorney, Agent, or Firm*—Young & Thompson

[57] ABSTRACT

A tool holder has a socket to receive the shank of a tool, a transverse bore breaking into the socket, and a tool retaining device for insertion in the transverse bore comprising a rigid retaining pin bonded to a resilient member which urges the retaining member sideways so that part of the retaining pin projects into the socket to engage the shank of a tool inserted therein. An elongate element is bonded to the resilient element and includes, at opposite ends thereof, stop members which overlie surfaces of the tool holder surrounding the ends of the bore, and thereby prevent longitudinal movement of the retaining device in the transverse bore. The stop members may be moved, by deformation of the resilient member, to a release position where they lie within the cross-section of the transverse bore, so that the retaining device may be inserted into, or withdrawn from, the bore.

10 Claims, 12 Drawing Figures

TOOL HOLDERS

BACKGROUND OF THE INVENTION

This invention relates to tool holders and particularly, though not exclusively, to holders for mining tools such as picks used in coal cutting machinery.

A coal cutting machine normally has a cutting element in the form of a driven endless chain, shearer drum or other driven assembly having a series of tool holders each formed with a socket in which a removable coal cutting pick can be mounted. Each tool holder has a transverse bore crossing and breaking into the socket, and a tool retaining device is inserted in the transverse bore to engage and retain the pick.

It is the object of the invention to provide an improved tool holder in which the tool retaining device is comparatively simple to install and which will satisfactorily retain a tool in position and yet allow the tool to be readily removed when required.

SUMMARY OF THE INVENTION

According to the invention there is provided a tool holder having a socket to receive the shank of a tool and a transverse bore crossing and breaking into the socket, and a tool retaining device for insertion in the transverse bore comprising a rigid retaining member and a resilient member of elastomeric material urging the retaining member sideways so that, in use, at least part of the retaining member projects into the socket to engage and locate the shank of a tool inserted therein, the retaining device also comprising, at opposite ends thereof, stop members mounted on the elastomeric material and having portions which are disposed beyond the ends of the transverse bore when the retaining device is located therein, which members are movable transversely to a longitudinal axis of the retaining device between a release position where said portions lie within the cross-section of the transverse bore, so that the retaining device may pass through the bore, and a locking position where they project outside the cross-section of the transverse bore so as to overlie surfaces of the tool holder surrounding the ends of the bore, thereby preventing longitudinal movement of the retaining device in the transverse bore.

Preferably the stop members are mounted for swinging movement about a longitudinal axis of the retaining device. The stop members may comprise the opposite end parts of a unitary element extending along the whole length of the retaining device. The unitary element may comprise an elongate portion which extends longitudinally of the retaining device and has at opposite ends thereof portions which extend substantially at right-angles thereto.

The stop members may be bonded to the elastomeric material in such manner as to lie in said locking position when the elastomeric material is unstressed, movement of the stop members to said release position causing resilient deformation of the elastomeric material. In this case, the resilient member is preferably so shaped that when the retaining device is located in the transverse bore, with the elastomeric material unstressed, at least a portion of the surface of the elastomeric material is spaced from the internal surface of the transverse bore sufficiently to ensure that said resilient deformation of the elastomeric material does not cause the surface thereof frictionally to engage the internal surface of the bore and thereby inhibit withdrawal of the retaining device from the bore.

Preferably the rigid retaining member is bonded to the resilient member.

Instead of the stop members being bonded to the elastomeric material, they may be mounted on or in the elastomeric material in such a manner that they may swing relatively to the elastomeric material between said locking and release positions, said swinging movement being restrained by frictional engagement between the said parts of the stop members and the elastomeric material.

The invention includes within its scope a tool retaining device, for use in a tool holder of any of the kinds referred to above, comprising a rigid retaining member, a resilient member of elastomeric material, and stop members mounted on the elastomeric material and having portions which are disposed beyond the ends of the retaining and resilient members, which members are movable transversely to a longitudinal axis of the retaining device between a release position where said portions lie within the combined cross-section of the retaining and resilient members, and a locking position where they project outside said combined cross-section.

DESCRIPTION OF THE PREFERRED EMBODIMENTS

Figure 1:
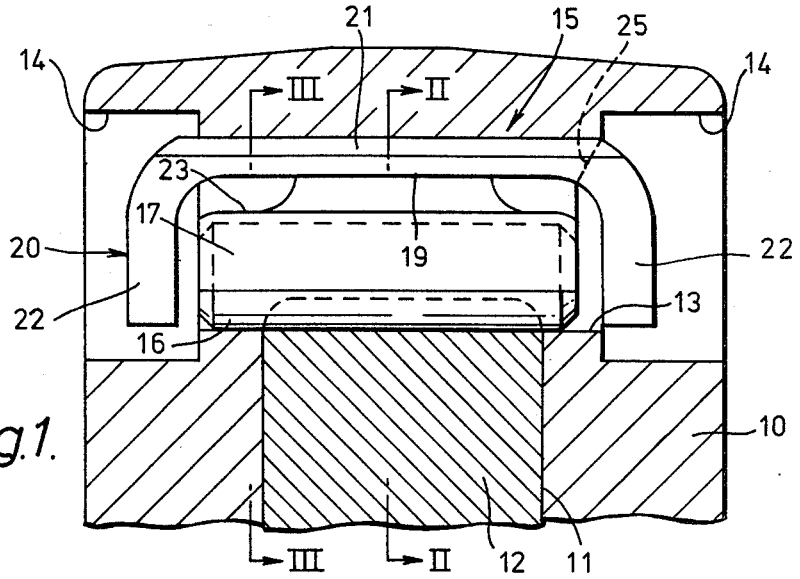
FIG. 1 is a section through part of a tool holder having a tool retained in the holder by a tool retaining device.

Referring to FIG. 1, the body 10 of the tool holder is formed with a generally rectangular socket 11 in which is received the shank 12 of a tool such as a coal cutting pick. A transverse bore 13 extends across the tool holder body 10 and crosses and breaks into the socket 11. The ends of the transverse bore 13 open into circular recesses 14 in the opposite surfaces of the tool holder body.

Figure 4:
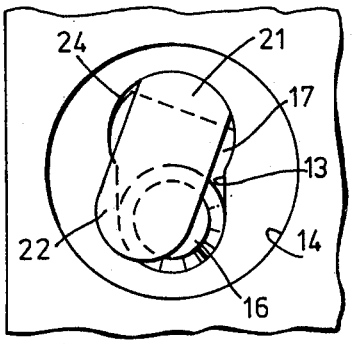
FIG. 4 is a side view of part of the tool holder of FIG. 1, looking on the end of the tool retaining device, showing the stop members in the locking position after insertion of the tool retaining device in the tool holder.
Figure 5:
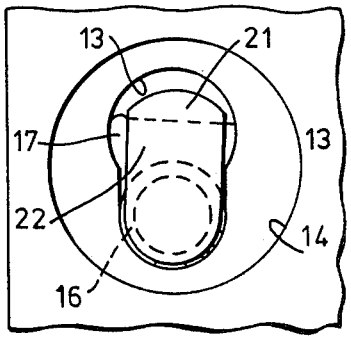
FIG. 5 is a smaller view to FIG. 4 showing the position of the stop members for insertion of the tool retaining device in the tool holder.

As best seen in FIGS. 4 and 5, the transverse bore 13 is keyhole-shaped in cross-section.

A tool retaining device 15 is provided for insertion in the transverse bore 13 to locate and retain the shank 12 of the tool within the socket 11. The tool retaining device comprises a circular cross-section metal retaining pin 16 which is bonded to a resilient member 17, being received in a part-cylindrical longitudinal groove 18 in that member.

Figure 2:
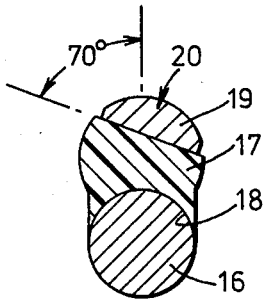
FIG. 2 is a section on the line II—II of FIG. 1.

On the opposite side thereof to the groove 18 the resilient member 17 is formed with a flat surface 19 disposed at an angle of about 70° to the central axis of the retaining device, as best seen in FIG. 2. Bonded to the flat surface 19 of the resilient member 17 is a metal element 20 having a central elongate portion 21 and end portions 22 which extend at right angles to the central portion and constitute stop members. Portions of the resilient member 17 are cut away adjacent opposite ends thereof, as indicated at 23 in FIGS. 1 and 3, so that only a central part of the resilient member engages and is bonded to the portion 21 of the metal element 20.

As best seen in FIGS. 4 and 5, each end portion 22 is in the form of a parallel sided arm having a rounded free end.

Due to the surface 19 of the resilient member being disposed at an angle to the central axis of the retaining device, part of each end portion 22 projects outside the cross-section of the rest of the tool retaining device when the elastomeric material is unstressed, as shown in FIG. 4.

In order to insert the tool retaining device in the tool holder, the end portions 22 of the metal element 20 are swung, deforming the elastomeric material, to the position shown in FIG. 5 where they lie within the cross-section of the tool retaining device and the transverse bore 13 so that the device may be inserted longitudinally in the bore 13 from one end thereof.

When the retaining device has been fully inserted in the bore 13 to the position shown in FIG. 1, the metal element 20 is released and, due to the resilience of the member 17, the end portions 22 return to the position shown in FIG. 4 where parts thereof overlie the surfaces of the tool holder surrounding the ends of the transverse bore 13, at the bottom of the recesses 14. The end portions 22 thus act as stop members preventing longitudinal movement of the retaining device out of the bore.

When the tool retaining device is in position in the tool holder, the tool may be fitted in the tool holder simply by forcing the shank 12 of the tool into the socket 11, whereby the pin 16 is moved inwardly of the transverse bore 13 against the resilient member 17 until a groove (not shown) in the shank is aligned with the transverse bore. Upon such alignment, the pin 16 springs into engagement with the groove in the shank 12 to locate and retain the tool in the socket 11. The tool is removed from the tool holder, in known manner, by using a suitable extractor which withdraws the tool shank from the socket, resilient compression of the member 17 allowing the pin 16 to move out of the groove in the shank as the shank is withdrawn.

If it is required to replace or remove the retaining device, the end portions 22 are pressed to the position shown in FIG. 5 where they may pass along the bore permitting withdrawal of the retaining device from the tool holder.

Figure 3:
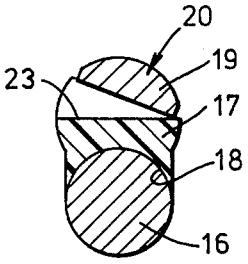
FIG. 3 is a section on the line III—III of FIG. 1.

As may be seen from FIGS. 2 and 3, the overall cross-sectional configuration of the tool retaining device has a keyhole shape corresponding generally to the keyhole shape of the bore 13. However, as may best be seen in FIG. 4, the resilient member 17 is so shaped that a part of the surface thereof is spaced from the internal surface of the bore 13, as indicated at 24 in FIG. 4, when the elastomeric material is unstressed. The purpose of this spring is so that when the resilient member 17 is deformed by movement of the end portions 22 to the release position shown in FIG. 5, there is room for the elastomeric material to expand outwardly, due to the deformation, without pressing unduly firmly on the internal surface of the bore 13, which would otherwise inhibit easy insertion or withdrawal of the retaining device into or out of the bore.

When the tool holder is in use in a cutting machine the material being cut sometimes applies a high pressure to the retaining device 15 in the axial direction thereof. Due to this high pressure the entire device is moved axially in the bore 13 (for example, to the left as seen in FIG. 1) until the righthand end portion 22 engages the bottom face of the recess 14. The pressure then imposes a bending movement on the element 20 and this is resisted by the relatively thick section of the element indicated at 25 in FIG. 1.

FIGS. 6 to 12 show alternative shapes for the tool retaining device, and components corresponding to components of the FIGS. 1 to 5 arrangement are given like reference numerals.

Figure 6:
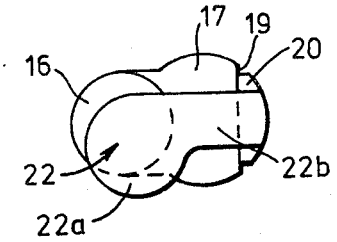
FIGS. 6 to 12 are end views of alternative forms of tool retaining device.

In the arrangement of FIG. 6, the flat surface 19 on the resilient member 17 is at right angles to the central line of the retaining device and this necessitates unsymmetrical shaping of each end portion 22. Each end portion therefore comprises a part-circular portion **22*a* connected to the end of the elongate portion 21 by an arm 22*b*** extending along the centre line of the cross-section of the retaining device.

Figure 7:
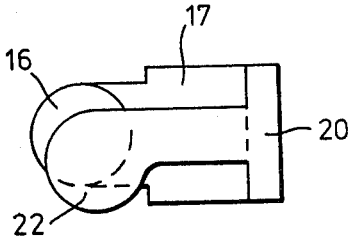

The arrangement of FIG. 7 employs a round retaining pin 16 and a part-rectangular resilient member 17 to be received in a similarly shaped slot in the tool holder.

Figure 8:
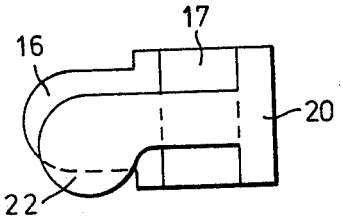

FIG. 8 shows a device also for use in a part-rectangular slot but in this case the retaining member 16 is shaped to extend into a part of the rectangular portion of the slot.

Figure 9:
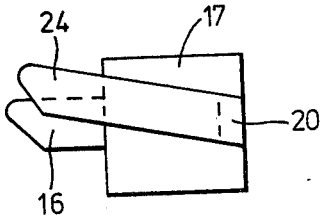

FIG. 9 shows a device where the retaining member 16 is not a round pin but is generally trapezium-shaped. The end portions 22 of the metal element are shaped according to the shape of the retaining member. It will be appreciated that any suitable shape of retaining member may be employed to suit the shape of the groove in the tool into which the member is to engage.

Figure 10:
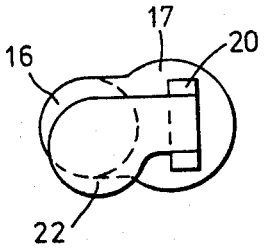

In the arrangement of FIG. 10 the elongate portion of the metal element 20 is moulded within the elastomeric material of the resilient member 17 instead of being bonded to one surface thereof as in the previously described arrangements.

Figure 11:
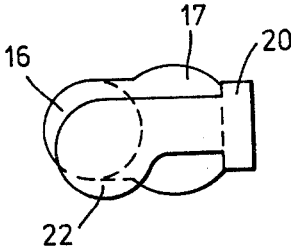

FIG. 11 shows a retaining device for use with a slot which will have a rectangular extension to receive the rectangular section elongate portion of the metal element 20.

Figure 12:
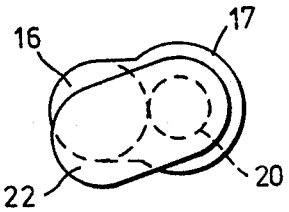

In the arrangement of FIG. 12 the metal element 20 is not bonded to the elastomeric material but has a circular cross-section elongate portion which is rotatable within a longitudinal bore in the resilient member 17. Thus the end portions 22 may be swung between the locking position and release position in either direction against the frictional restraint provided by the engagement of the elongate portion with the elastomeric material. However, it will be appreciated that in the arrangement of FIG. 12 the circular cross-section portion of the metal element could also be bonded to the elastomeric material, in which case the device would operate in a similar manner to the previously described devices, the movement of the end portions 22 to the release position being accompanied by deformation of the elastomeric material.

Although it is preferable, in all of the above arrangements, for the retaining member 16 and the metal element 20 to be bonded to the elastomeric member 17, so that the device forms a convenient unit, either or both said parts may be separate from the elastomeric material, the parts merely being assembled together before insertion in the tool holder.

Although the element 20 has been described as being metal, it may be made from any suitable material. It is so shaped that the end portions 22 are able to withstand any of the forces which, in use, tend to move retaining devices of this kind longitudinally relative to the tool holder.

The retaining device can be inserted from either side of the tool holder and access is only necessary to that side of the holder from which it is inserted. This is an advantage over existing devices which often necessitate access to both sides of the tool holder. The arrangement according to the present invention is therefore advantageous when designing a tool holder for use where space is limited.

I claim:

1. A tool holder having a socket to receive the shank of a tool and a transverse bore crossing and breaking into the socket, and a tool retaining device for insertion in the transverse bore comprising a rigid retaining member and a resilient member of elastomeric material urging the retaining member sideways so that, in use, at least part of the retaining member projects into the socket to engage and locate the shank of a tool inserted therein, the retaining device also comprising, at opposite ends thereof, stop members mounted on the elastomeric material and having portions which are disposed beyond the ends of the transverse bore when the retaining device is located therein, which members are movable transversely to a longitudinal axis of the retaining device between a release position where said portions lie within the cross-section of the transverse bore, so that the retaining device may pass through the bore, and a locking position where they project outside the cross-section of the transverse bore so as to overlie surfaces of the tool holder surrounding the ends of the bore, thereby preventing longitudinal movement of the retaining device in the transverse bore.

2. A tool holder according to claim 1, wherein the stop members are mounted for swinging movement about a longitudinal axis of the retaining device.

3. A tool holder according to claim 1, wherein the stop members comprise the opposite end parts of a unitary element extending along the whole length of the retaining device.

4. A tool holder according to claim 3, wherein the unitary element comprises an elongate portion which extends longitudinally of the retaining device and has at opposite ends thereof portions which extend substantially at rightangles thereto.

5. A tool holder according to claim 4, wherein said end portions extend substantially at right angles away from a flat surface on the elongate portion of the unitary element, which flat surface engages a flat surface on the resilient member which is inclined at an angle of less than 90° to the central axis of the retaining device so that said end portions are inclined with respect to said axis.

6. A tool holder according to claim 1, wherein the stop members are bonded to the elastomeric material in such manner as to lie in said locking position when the elastomeric material is unstressed, movement of the stop members to said release position causing resilient deformation of the elastomeric material.

7. A tool holder according to claim 6, wherein the resilient member is so shaped that when the retaining device is located in the transverse bore, with the elastomeric material unstressed, at least a portion of the surface of the elastomeric material is spaced from the internal surface of the transverse bore sufficiently to ensure that said resilient deformation of the elastomeric material does not cause the surface thereof frictionally to engage the internal surface of the bore and thereby inhibit withdrawal of the retaining device from the bore.

8. A tool holder according to claim 1, wherein the rigid retaining member is bonded to the resilient member.

9. A tool holder according to claim 1, wherein parts of the stop members are mounted on the elastomeric material in such a manner that they may swing relatively to the elastomeric material between said locking and release positions, said swinging movement being restrained by frictional engagement between the said parts of the stop members and the elastomeric material.

10. A tool retaining device comprising a rigid retaining member, a resilient member of elastomeric material, and stop members mounted on the elastomeric material and having portions which are disposed beyond the ends of the retaining and resilient members, which members are movable transversely to a longitudinal axis of the retaining device between a release position where said portions lie within the combined cross-section of the retaining and resilient members, and a locking position where they project outside said combined cross-section.

* * * * *